United States Patent [19]

Garganese

[11] 4,335,830

[45] Jun. 22, 1982

[54] SOLUTION CONTAINER

[75] Inventor: Richard S. Garganese, North Kingston, R.I.

[73] Assignee: Industrial Packaging Co., Inc., Bristol, R.I.

[21] Appl. No.: 208,133

[22] Filed: Nov. 17, 1980

[51] Int. Cl.[3] ..... B65D 5/30; B65D 5/56

[52] U.S. Cl. ..... 220/462; 206/805; 229/30; 229/32; 229/41 B

[58] Field of Search ..... 229/16 R, 30, 31 R, 229/32, 35, 41 R, 41 B, 50; 206/805; 220/416, 461, 462, 6, 62

[56] References Cited

U.S. PATENT DOCUMENTS

| | | | |
|---|---|---|---|
| 555,876 | 3/1896 | Norrington | 229/41 R |
| 2,221,368 | 11/1940 | Buser | 229/41 B |
| 2,332,642 | 10/1943 | Johnson | 206/805 |
| 3,300,166 | 1/1967 | Wojciechowski | 229/41 B |
| 3,386,644 | 6/1968 | Zackheim | 229/41 B |
| 3,391,848 | 7/1968 | Schmidt | 229/41 B |
| 3,489,331 | 1/1970 | Anderson | 220/461 |
| 3,905,544 | 9/1975 | Tipton | 228/41 B |

FOREIGN PATENT DOCUMENTS

| | | | |
|---|---|---|---|
| 528911 | 8/1956 | Canada | 229/32 |
| 402426 | 10/1909 | France | 229/41 B |
| 2646 | 9/1890 | Switzerland | 206/805 |
| 337306 | 10/1930 | United Kingdom | 229/32 |

*Primary Examiner*—Stephen Marcus
*Attorney, Agent, or Firm*—Salter & Michaelson

[57] ABSTRACT

A collapsible solution container is disclosed having a flat rectangular bottom wall, a pair of side walls and a pair of end walls. The side walls and end walls are hingedly attached to the bottom wall and cooperate to define a container when positioned perpendicular to said bottom wall. A resilient band is extended along the outer surfaces of the side walls and the inner surfaces of the end walls, said band causing the container to be automatically erected from a flat collapsed position. A flexible waterproof sheet is adhered to the inner surfaces of the container and extends between the side walls and end walls to provide a waterproof interior for the container.

5 Claims, 7 Drawing Figures

SOLUTION CONTAINER

BACKGROUND OF THE INVENTION

The present invention relates to collapsible containers which may be quickly and easily erected from a flat to an open position.

Prior to the instant invention some attempts have been made to produce containers and boxes that are readily erected or assembled from a flat to an open position, and examples of such construction are illustrated in the following United States patents, which also represent the best prior art known to applicant and to which the subject invention pertains: Drawbaugh, U.S. Pat. No. 676,393; Unser, U.S. Pat. No. 1,509,454; Mustin, U.S. Pat. No. 1,745,947; Ullrich, U.S. Pat. No. 2,296,126; Johnson, U.S. Pat. No. 2,332,642; Langford, U.S. Pat. No. 2,965,275; and Whitaker, U.S. Pat. No. 3,411,691.

Some of the containers as illustrated in the aforesaid patents are moved from a flat to an erected position through the use of strings that extend through holes formed in the walls of the containers. These prior known containers, however, all require a certain amount of manipulation by the user to cause them to move to the erected position. Other containers illustrated in the prior patents are erected by the user from a prefolded collapsed form in a series of predetermined steps, but all of these containers, however, still required a certain amount of manipulation by the user to erect to an open position.

The container herein described can also be made waterproof to accomodate liquids or solutions therein and is particularly applicable for hospital use on those occasions where a nurse or attendant may need to assemble a container quickly while attending to a patient. In such application, the container herein described can be instantly and automatically erected to an open position by a nurse or other attendant with one hand and therefore represents a substantial improvement over collapsible waterproof containers heretofore available.

SUMMARY OF THE INVENTION

The present invention relates to a unique form of container which may be automatically and instantly erected by the user with a single movement of one hand. The container can either be used to contain articles therein or can be adapted to contain liquids or solutions therein.

The container of the subject invention may be produced in quantity from a single sheet of cardboard or other rigid material by die stamping the sheet to cut or score the perimeters of the walls of the container which provides for folding the walls in an appropriate manner to form the container. A resilient band engages the end walls and side walls to cause the walls to automatically seek and be retained in a fully erected position upon a simple manipulation by the user.

The container may be stored prior to use in a flat collapsed position with the various walls folded on top of one another in a predetermined manner and the resilient band as also holds the walls in the collapsed position prior to use. In order to erect the container the user simply lifts the resilient band from engagement with the folded walls, which causes the side and end walls to be urged to an upright assembled position, whereby the walls interlock to secure the corners of the container in the assembled or erected position.

Accordingly it is an object of the present invention to provide a container which may be stored in a flat, collapsed position and instantly and automatically erected when desired.

Another object of the present invention is to provide a waterproof container which may be stored in a flat collapsed position and which includes a resilient band that is operable to move the container walls to an erected position when desired.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 6:
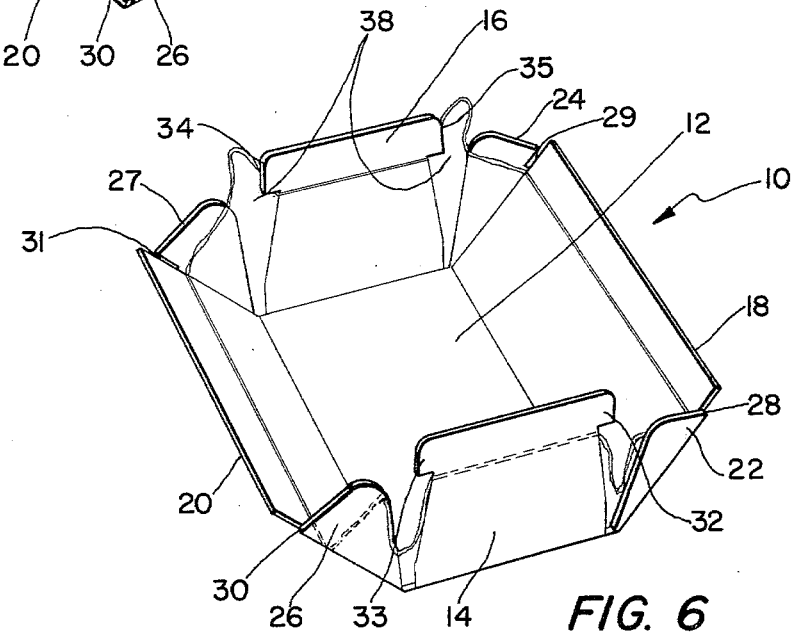
FIG. 6 is a perspective view of the container showing the configuration of the walls thereof.

Referring now to the drawings and particularly to FIG. 6, the container embodiment in the present invention is illustrated in a partially erected form after a blank is die cut and scored and is generally indicated at 10. As will be described, the container 10 is normally formed with an interior waterproof film and also includes a resileint band that is provided for retaining the container in a flat folded position and for the quick erecting of this container to the open assembled position.

As shown in FIG. 6, the container 10 includes a flat rectangular bottom wall 12, opposed end walls 14 and 16 and opposed side walls 18 and 20. The side walls 18, 20 are hingedly attached to opposing side edges of the rectangular bottom wall 12 and similarly the end walls 14, 16 are hingedly attached to opposite ends of the bottom wall 12. As further illustrated in FIG. 6, the side wall 18 has flaps 22 and 24 attached to the ends thereof while side wall 20 has flaps 26 and 27 similarly attached thereto. Interior notches are formed in the flaps 22 and 24 which define slots 28 and 29 respectively on the opposite edges of the side wall 18. Similar slots 30 and 31 are formed on opposite edges of the side wall 20 by interior notches that are cut in the flaps 26 and 27. Formed on the end wall 14 are laterally extending tabs 32 and 33 which are defined by undercutting the side edges of the end wall 14 adjacent to the upper end thereof. Tabs 34 and 35 are also formed on the side edges of the side wall 16 and it is seen that the tabs 32,33 and 34, 35 coact with the slots 28, 30 and 29, 31 respectively to lock the side and end walls together and in perependicular relation to the bottom wall 12 in the erected position of the container.

Figure 5:
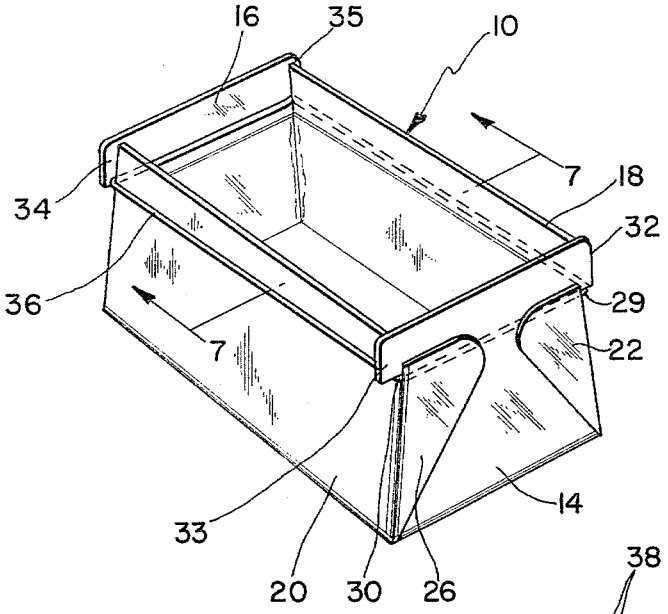
FIG. 5 is a perspective view of the completely erected container.

Referring now to FIG. 5, of the drawings the container 10 is shown in the fully assembled and erected position. In this position a single resilient band 36 is utilized to maintain the container walls in locked position and as shown the resilient band 36 extends around the outer surfaces of the side walls 18 and 20 and the inner surfaces of the end walls 18 and 20 and the inner surfaces of the end walls 14 and 16. When the container 10 is located in the fully erected position, the band 36 does not exert any substantial force on the end walls 14 and 16 but does exert an inward force on the side walls 18 and 20, thereby restricting the outward movement thereof. The side walls 14 and 22 are also restrained from inward movement and are therefore retained in a fully erected position by the end walls 24 and 26 which are positioned therebetween. It is also seen that the end walls 24 and 26 are retained in the fully erected position by the interaction of the flaps 22, 24, 26 and 27 and slots 28, 29, 30 and 31 with the tabs 32, 33, 34 and 35. In this connection the tabs 32, 33 and 34, 35 engage their respective adjacent slots 28, 30 and 29, 31 and are retained therein. Thus inward movement of the end walls 14 and 16 is prevented since the side walls 18 and 20 are positioned between the adjacent tabs thereof. Outward movement of the end walls 14 and 16 is prevented by the flaps 22, 26 and 24, 27 which engage their respective adjacent tabs 32, 33 and 34, 35 and thereby retain the end walls in the erected position.

Figure 1:
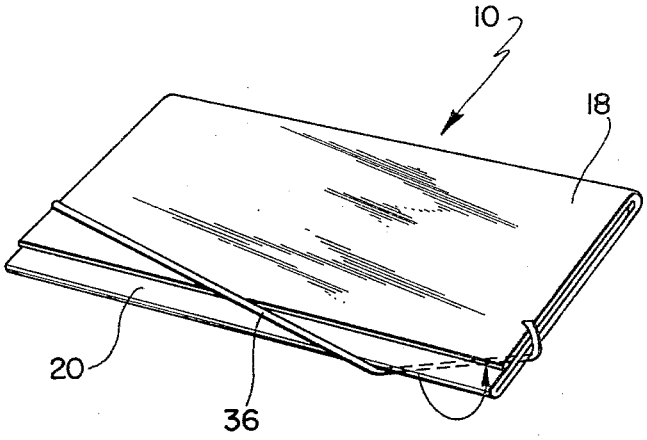
FIG. 1 is a perspective view showing the container embodied in the instant invention in a collapsed condition.
Figure 2:
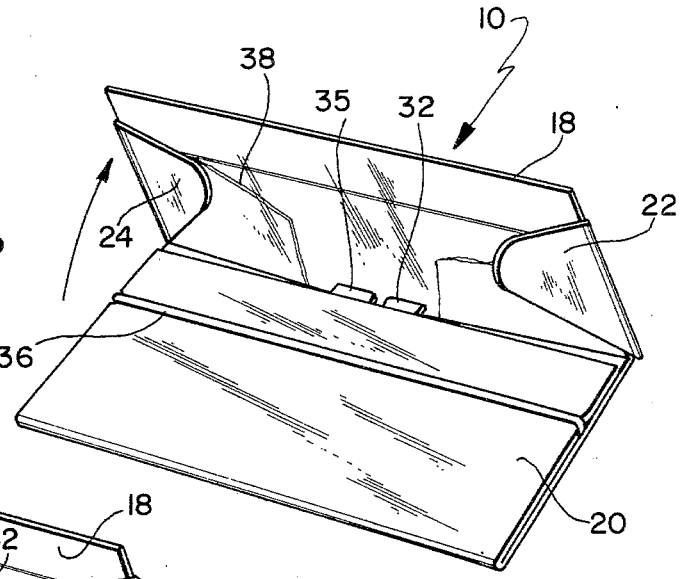
FIG. 2 is a perspective view of the container showing one side wall erected.
Figure 3:
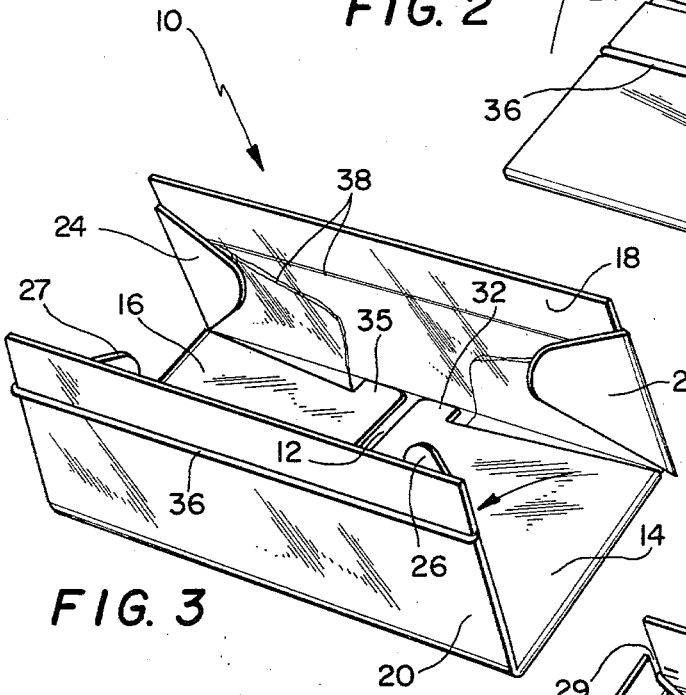
FIG. 3 is a perspective view of the container showing both side walls erected.
Figure 4:
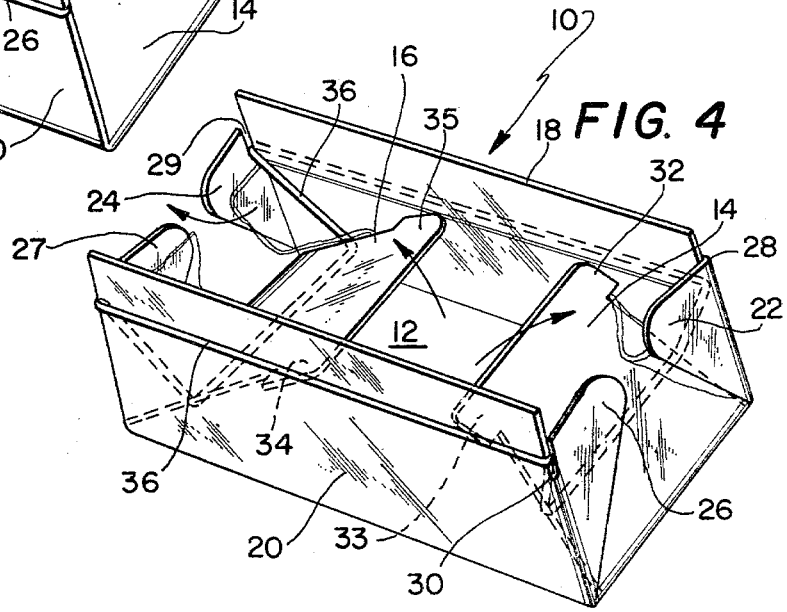
FIG. 4 is a perspective view of the container showing both side walls erected and both end walls partially erected.

In order to collapse the container 10, the walls thereof are folded over one another in a predetermined manner to produce the configuration shown in FIG. 1. With the container 10 located in its fully erected position as shown in FIG. 5, the end walls 14 and 16 and the tabs 32, 33 and 34, 35 are disengaged from their respective slots and the flaps 22, 26 and 24, 27 are then folded inwardly, the end walls 14 and 16 pivoting along their respective lines of intersection with the bottom wall 12. As the end walls 14 and 16 are pivoted inwardly as is shown in FIGS. 3 and 4, the resilient band 18 slides downwardly along the inner surfaces thereof. When the end walls 14 and 16 reach the flat position and overlie the bottom wall 12, the resilient band 18 is repositioned along the lines of intersection of the bottom wall 12 and the end walls 14 and 16. The flaps 22, 26 and 24, 27 are thereafter folded inwardly along the inner surfaces of the corresponding side walls 18 and 20 and the side walls are then folded inwardly over one another and over the collapsed end walls 14 and 16 to complete the collapsing of the container as shown in FIGS. 1 and 2. The container is retained in the collapsed position by extending the resilient band 36 diagonally along the outer surface of the uppermost folded side wall and around the adjacent corner thereof and along a portion of the lower surface of the bottom wall 12 as also shown in FIG. 1. It is understood that other means of retaining the container walls in the collapsed position could be utilized, for example a small piece of tape or other adhesive retaining material could be provided that would overlie the folded walls to retain them in the collapsed position.

Figure 7:
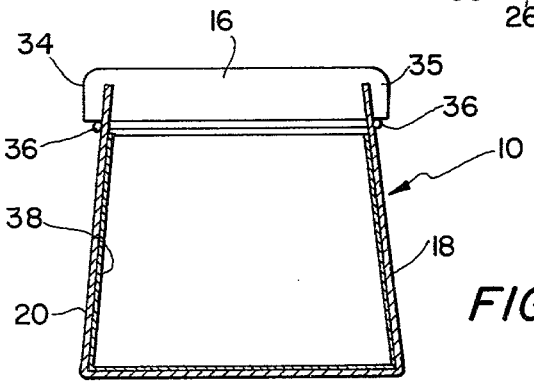
FIG. 7 is an end sectional view of the erected container taken along line 7—7 in FIG. 5.

It is contemplated that the container 10 will be utilized for hospital or medical purposes and primarily for receiving a liquid therein. Since the container interior must be leak proof for this purpose, a relatively thin flexible plastic film or sheet indicated at 38 in FIG. 7 is provided and is secured to the inner surfaces of the container walls. In this connection the sheet is adhered by an adhesive or the like or heat sealed to the bottom side and end walls, as well as to the flaps after the container blank has been die cut and is in the flat open position. The sheet 38 is proportioned so that it covers the entire bottom wall 12 and the main portions of the side and end walls, terminating just below the interlocking structure thereof. The sheet 38 also extends between the edges of the flaps and end walls thereby sealing the corners of the container 10 when the walls thereof are in the fully erected position.

In use the collapsed container is quickly moved to the assembled and erected position from the collapsed form shown in FIG. 1 by simply releasing the retaining means hereinabove described, which is accomplished by repositioning the portion of band 36 that extends along the bottom wall 12 for location at the outer surface of the top of the side wall 18. Upon release of the resilient band 36, the side and end walls are then automatically erected, the resilient band 36 thereafter exerting an outward force on the end walls 14 and 16 to cause them to pivot on the bottom wall upwardly to the open position as shown in FIG. 4. As the end walls 14 and 16 are pivoted as described, the resilient band 36 is repositioned upwardly along the inner surfaces thereof thereby causing further pivotal movement of the end walls. The upward pivotal movement of the end walls 14 and 16 causes a similar pivotal movement of the sidewalls 18 and 20 from the collapsed position. When the side and end walls reach the fully erected positions, the tabs engage their respective adjacent slots and flaps and become interlocked therewith, thereby securing the walls in the fully erected position as shown in FIG. 5.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A collapsible container comprising:

A. a flat bottom wall;

B. a pair of spaced side walls, each of which is hingedly attached to said bottom wall on opposing edges thereof;

C. a pair of spaced end walls, each of which is hingedly attached to said bottom wall on opposing edges thereof, said side and end walls being pivotally movable relative to said bottom wall for location in perpendicular relation with respect thereto when the container walls are moved from a collapsed to an erected position;

D. means formed on said side and end walls for interlocking said side and end walls in the erected positions thereof; and E. a resilient band extending along the outer surfaces of said side walls and the inner surfaces of said end walls, and coacting with said side and end walls to normally urge them to the erected positions thereof, said resilient band being movable into a position relative to all of said walls to automatically urge said walls from a collapsed to an erected position.

2. The collapsible container of claim 1, said interlocking means including a plurality of flaps that are hingedly attached to side edges of said side walls for engaging said end walls when the container is in the erected position thereof.

3. The collapsible container of claim 2, said interlocking means further including a plurality of tabs extending from the upper portions of the vertical edges of said end walls, a plurality of slots extending partially along the upper portions of the lines of intersection of said side walls and flaps, said tabs and slots engaging to interlock and secure the container in the erected position thereof.

4. The collapsible container of claim 2, a flexible waterproof sheet being attached to the inner surfaces of said walls and tabs so that when the walls of the container are disposed in the erected position a waterproof container is defined.

5. The collapsible container of claim 3, a flexible waterproof sheet being attached to the inner surfaces of said walls so that when the walls of the container are disposed in the erected position a waterproof container is defined.

* * * * *